US007393251B2

(12) United States Patent
Sakamaki et al.

(10) Patent No.: US 7,393,251 B2
(45) Date of Patent: Jul. 1, 2008

(54) CONNECTOR

(75) Inventors: Kazushige Sakamaki, Tokyo (JP); Ryuichi Komiyama, Tokyo (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 17 days.

(21) Appl. No.: 11/180,747

(22) Filed: Jul. 12, 2005

(65) Prior Publication Data

US 2006/0035534 A1 Feb. 16, 2006

(30) Foreign Application Priority Data

Jul. 12, 2004 (JP) ..... 2004-205020

(51) Int. Cl.
*H01R 13/40* (2006.01)

(52) U.S. Cl. ..... 439/733.1

(58) Field of Classification Search ..... 439/733.1, 439/631, 495, 885, 499, 260, 67, 77, 492–493, 439/496, 374
See application file for complete search history.

(56) References Cited

U.S. PATENT DOCUMENTS 5,599,194 A 2/1997 Ozawa et al.
5,695,359 A * 12/1997 Fujikura et al. ..... 439/495
5,906,504 A 5/1999 Igarashi et al.
5,967,856 A 10/1999 Meller
6,059,595 A 5/2000 Lacrouts-Cazenave
6,250,966 B1 * 6/2001 Hashimoto et al. ..... 439/631
6,280,239 B1 * 8/2001 Cheng ..... 439/495
6,280,240 B1 * 8/2001 Chang ..... 439/495
6,733,325 B2 * 5/2004 Sakai et al. ..... 439/495

FOREIGN PATENT DOCUMENTS

EP 1 061 614 A2 12/2000
JP 07-296886 11/1995
JP 2001-196119 7/2001
WO WO 03/096485 A1 11/2003

OTHER PUBLICATIONS

European Search Report dated Oct. 11, 2005 for Application No. EP 05 10 6053.

* cited by examiner

*Primary Examiner*—Edwin A. León
(74) *Attorney, Agent, or Firm*—Barley Snyder LLC

(57) ABSTRACT

A connector comprises a housing including a recess for receiving a mating connector. First contacts with first press-fit sections are press-fitted into the housing. The first contacts include first contact sections extending substantially parallel to the first press-fit sections that extend into the recess. The first spring sections connect the first press-fit sections to the first contact sections. The first spring sections elastically deform to cause the first contact sections to move with respect to a direction of insertion of the mating connector into the recess.

17 Claims, 3 Drawing Sheets

CONNECTOR

FIELD OF THE INVENTION

The invention relates to a connector having a housing provided with first and second contacts that extend into a recess in the housing for engagement with corresponding contacts in a mating connector.

BACKGROUND OF THE INVENTION

When contacts of a first connector are connected to corresponding contacts of a mating connector, for example, in a vehicle, contact points of the contacts tend to slide slightly. This sliding occurs because the contacts are caused to move by vibrations from the engine or the like, which causes the contact points to slide. This sliding causes abrasions that lead to poor contact between the contact points. In order to maintain a connection between the contacts, there has been proposed a technique in which an elastic body is formed on each of the female contacts, as shown, for example, in Japanese Patent Publication No. 7-296886. In this example, however, the length of the elastic body causes the length of the female contacts to become longer in a mating direction, which causes the entire connector to become longer.

In order to address the above problem, there has been proposed a technique in which an elastic pressing member is provided on each of the male contacts, as shown, for example, in Japanese Patent Publication No. 2001-196119. In this example, the elastic pressing member is formed at a base of the male contact. When the male contact is fitted into a corresponding female contact, the elastic pressing member is pressed by a tip of the corresponding female contact into which the male contact is fitted. This configuration enables interlocking movement of the male and female contacts and can reduce abrasion by slight sliding due to vibration while maintaining the conventional length of the male contact. In this example, however, abrasion is not prevented by sliding that occurs due to the expansion and/or retraction of the male and/or female contacts and/or the connectors due to temperature changes. Because a change in temperature will expand and/or retract the male and/or female contacts and/or the connectors, the elastic pressing members of the male contacts may not abut the tips of the corresponding female contacts such that interlocking of the male and female contacts may not be ensured.

SUMMARY OF THE INVENTION

It is therefore an object of the invention to provide a connector which reduces abrasion caused by sliding.

This and other objects are achieved by a connector comprising a housing including a recess for receiving a mating connector. First contacts with first press-fit sections are press-fitted into the housing. The first contacts include first contact sections extending substantially parallel to the first press-fit sections that extend into the recess. The first spring sections connect the first press-fit sections to the first contact sections. The first spring sections elastically deform to cause the first contact sections to move with respect to a direction of insertion of the mating connector into the recess.

This and other objects are further achieved by a connector comprising a housing including a recess for receiving a mating connector. First contacts with first press-fit sections are press-fitted into the housing. The first contacts include first contact sections extending substantially parallel to the first press-fit sections that extend into the recess. The first spring sections connect the first press-fit sections to the first contact sections. The first spring sections elastically deform to cause the first contact sections to move with respect to a direction of insertion of the mating connector into the recess. Second contacts with second press-fit sections are press-fitted into the housing. The second contacts include second contact sections extending substantially parallel to the second press-fit sections that extend into the recess. The second spring sections connect the second press-fit sections to the second contact sections. The second spring sections elastically deform to cause the second contact sections to move with respect to a direction of insertion of the mating connector into the recess.

BRIEF DESCRIPTION OF THE DRAWINGS

FIG. 1(*b*) is a partial perspective sectional view of the connector of FIG. 1(*a*) showing a second contact;

FIG. 3(*b*) is a sectional view of the connector showing the second contact housed in the connector.

DETAILED DESCRIPTION OF THE INVENTION

Figure 1B:
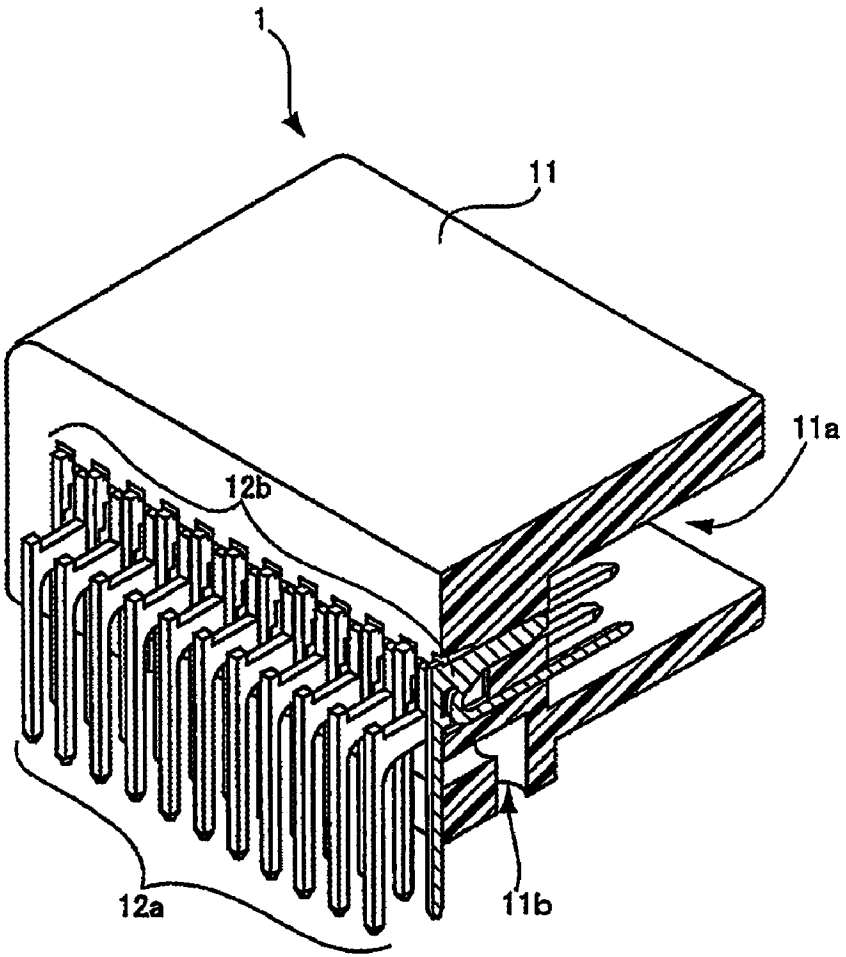
FIG. 1(*a*) is a partial perspective sectional view of a connector according to the invention showing a first contact.
Figure 1A:
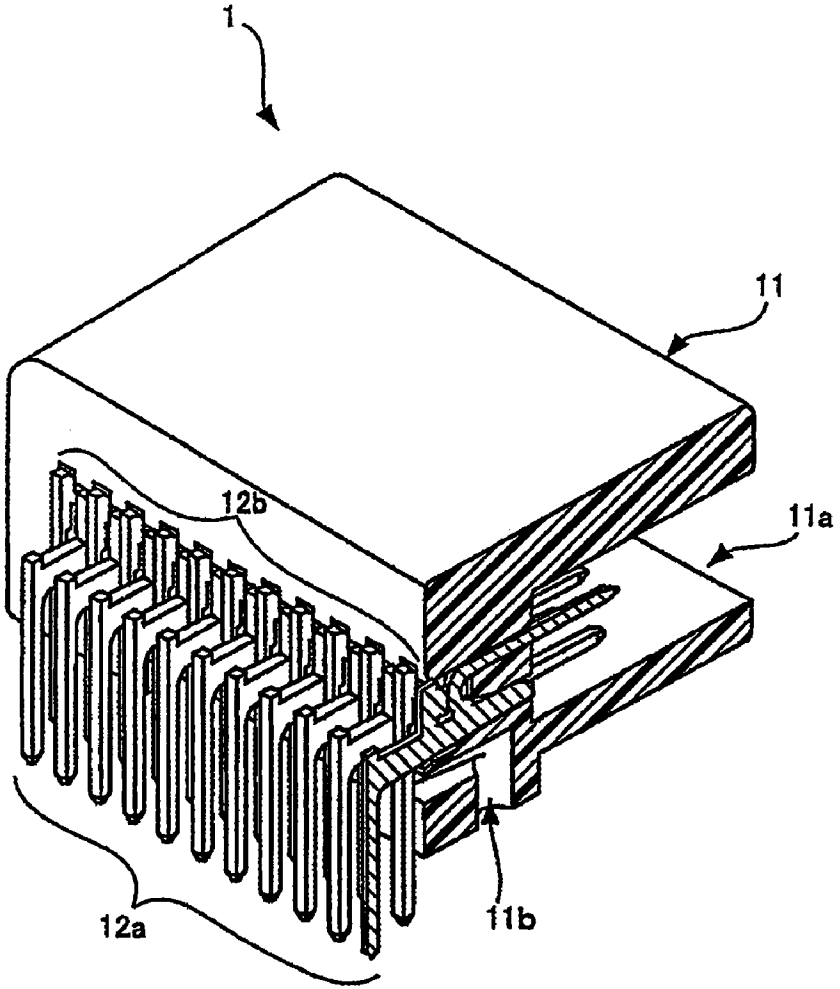
Figure 2:
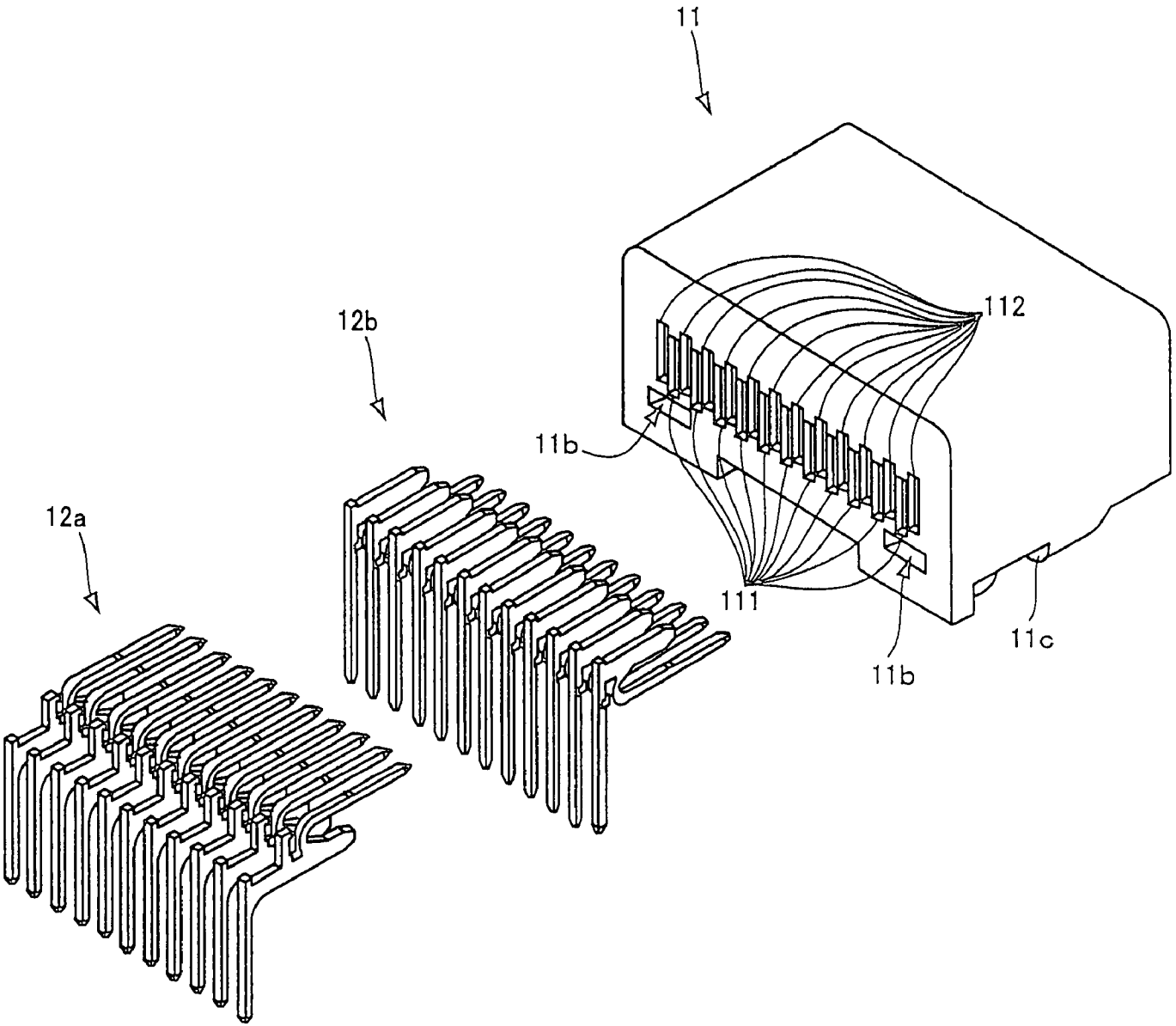
FIG. 2 is an exploded view of the connector.
Figure 3A:
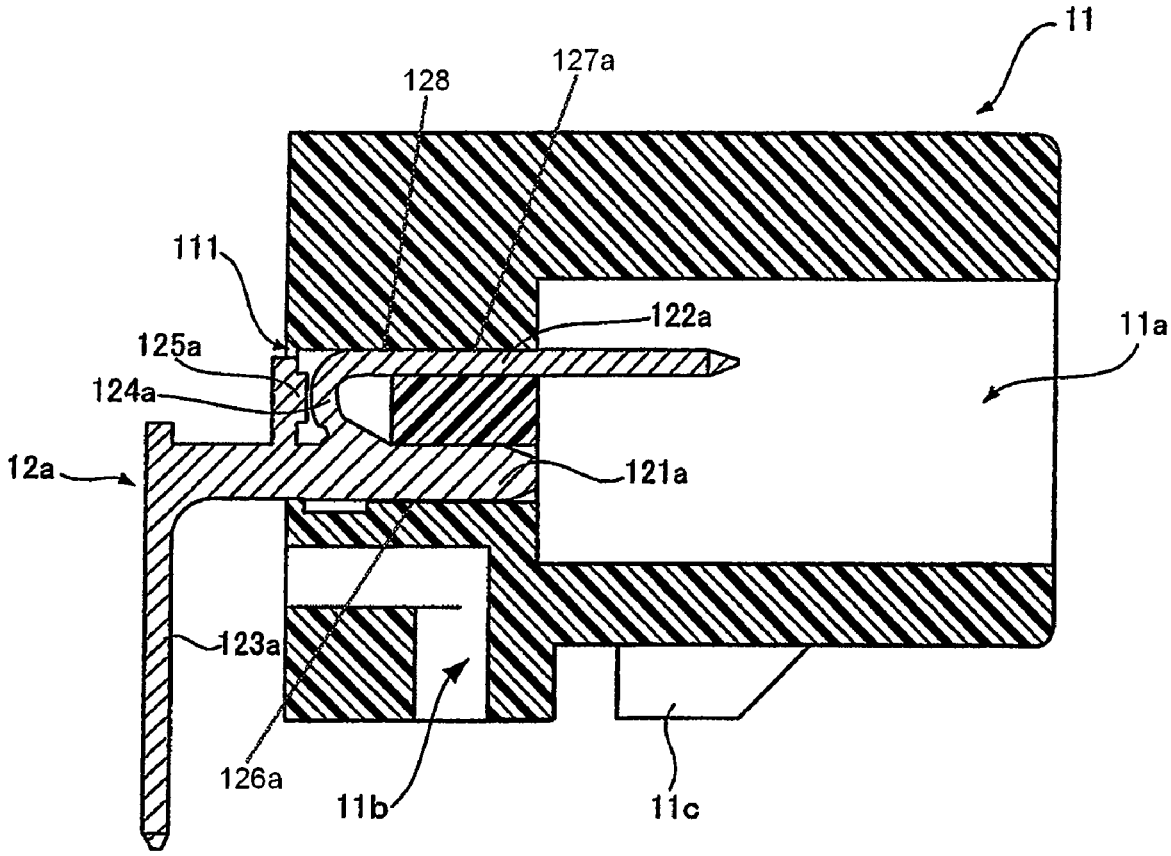
FIG. 3(*a*) is a sectional view of the connector showing the first contact housed in the connector.
Figure 3B:
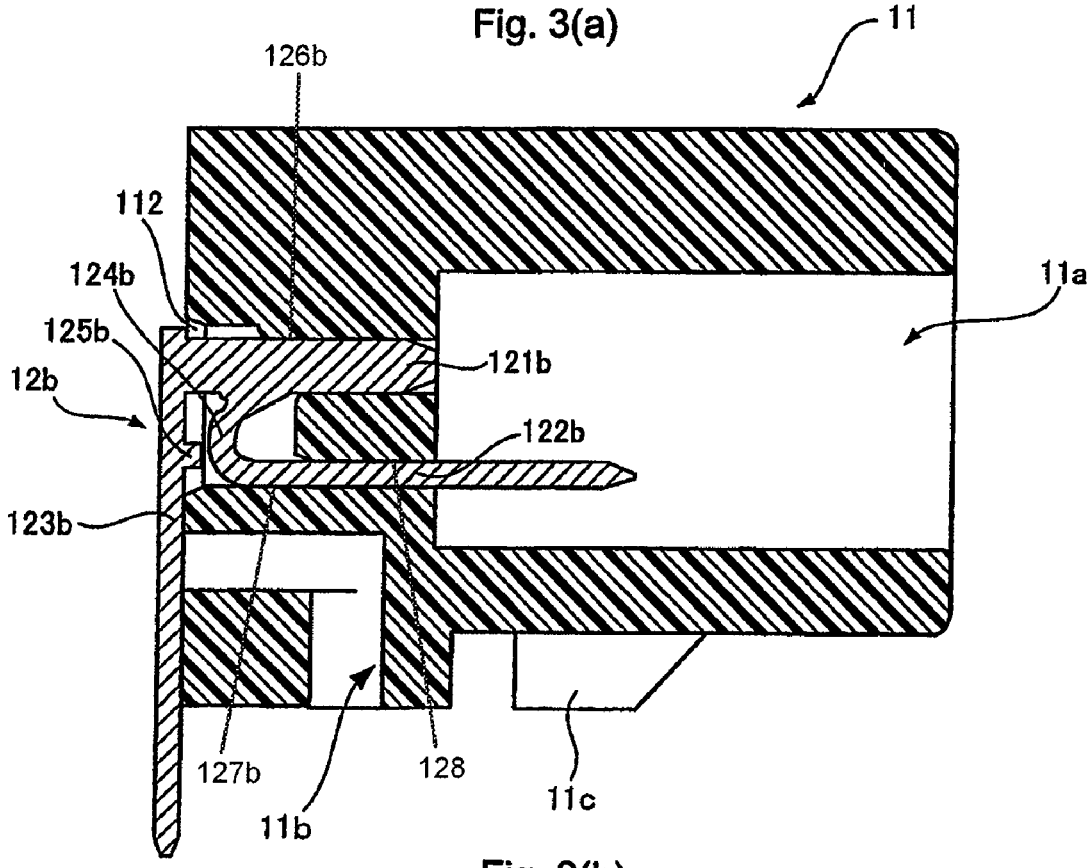

FIGS. 1(*a*)-1(*b*) show a connector 1. The connector 1 comprises a housing 11 with a recess 11*a* for receiving a mating connector (not shown). First and second contacts 12*a*, 12*b* are press-fit into the housing 11. As shown in FIG. 2, the first contacts 12*a* are received in a first housing section 111, and the second contacts 12*b* are received in a second housing section 112. The first housing section 111 includes a first press-fit section receiving opening 126*a* and a first contact section receiving opening 127*a*. The second housing section 112 includes a second press-fit section receiving opening 126*b* and a second contact section receiving opening 127*b*. The first and second contact section receiving openings 127*a*. 127*b* have inner walls 128. Although the connector 1 is illustrated as having two types of male contacts, it will be appreciated by those skilled in the art that one type of contact or more then two types of contacts may alternatively be provided in the connector 1. An aperture 11*b* extends adjacent to the first and second housing sections 111, 112 to a bottom surface of the housing 11, as shown in FIGS. 3(*a*)-3(*b*). The aperture 11*b* has a substantially reverse L-shape and is formed, for example, to receive a self-tap screw (not shown) for fixing the housing 11 to a substrate (not shown). A standoff 11*c* is formed on the bottom surface of the housing 11. The standoff 11*c* stabilizes the position of the housing 11, for example, when the housing 11 is being fixed to the substrate (not shown) by the self-tap screw (not shown) received in the bottom of the housing 11.

As shown in FIG. 3(*a*), each of the first contacts 12*a* comprises a first press-fit section 121*a*, a first contact section 122*a*, a first connection section 123*a*, a first spring section 124*a*, and a first projection 125*a*. The first contact section 122*a* includes a tip that extends substantially parallel to the first press-fit section 121*a*. The first contact section 122*a* is connected to the first press-fit section 121*a* by the first spring section 124*a*. The first spring section 124*a* is elastically deformable with respect to a direction of insertion of the mating connector (not shown) into the recess 11*a*. The first contacts 12*a* may be formed, for example, by plating a stamped metal plate or stamping a plated material.

To secure the first contacts 12*a* to the housing 11, the first press-fit section 121*a* is press-fit into the first press-fit section receiving opening 126*a* of the housing 11. In this position, the tip of the first contact section 122*a* extends through the first contact section receiving opening 127*a* into the recess 11*a* of the housing 11 for contact with a corresponding contact of the mating connector (not shown). The first connection section 123a extends outside of the housing 11 for connection, for example, to a substrate (not shown). When the mating connector (not shown) is fitted into the recess 11*a*, the first spring section 124*a* elastically deforms when pressed by the corresponding contact (not shown) of the mating connector (not shown). When the first spring section 124*a* elastically deforms, the spring contact 124*a* abuts the first projection 125*a*, which prevents excessive stress and/or plastic deformation.

As shown in FIG. 3(*b*), each of the second contact 12*b* comprises a second press-fit section 121*b*, a second contact section 122*b*, a second connection section 123*b*, a second spring section 124*b*, and a second projection 125*b*. The second contacts 12*b*, however, have a slightly different shape than the first contacts 12*a*. Because the second contacts 12*b* operate in the same manner as the first contact 12*a*, the operation thereof will not be explained in greater detail herein.

Although, the first and second spring sections 124*a*, 124*b* are shown in the illustrated embodiment as having a substantially U-shaped configuration, it will be appreciated by those skilled in the art that the first and second spring sections 124*a*, 124*b* are not limited to a substantially U-shaped configuration. Other configurations are possible, which extend between the first and second press-fit sections 121*a*, 121*b* and the first and second contact sections 122*a*, 122*b*. Further, flat abutment sections may be provided instead of the first and second projections 125*a*, 125*b*. The first and second projections 125*a*, 125*b* may also be formed on the housing 11 instead of on the first and second contacts 12*a*, 12*b*. Additionally, the first and second contacts 12*a*, 12*b* may be formed without the first and second projections 125*a*, 125*b*. In addition, the first and second connection sections 123*a*, 123*b* may be formed for surface mounting.

As previously discussed, the first and second contacts 12*a*, 12*b* are provided with the first and second spring sections 124*a*, 124*b*, respectively, which connect the first and second press-fit sections 121*a*, 121*b*, respectively, to the first and second contact sections 122*a*, 122*b*, respectively. Thus, the first and second contact sections 122*a*, 122*b* elastically deform in the direction of insertion of the mating connector (not shown) into the recess 11*a*. As a result, the first contacts 12*a* and the second contacts 12*b* absorb vibrations and/or expansions and retractions due to temperature changes, which weaken the contact between the first and second contacts 12*a*, 12*b* and the corresponding contacts (not shown) in the mating connector (not shown). Accordingly, sliding, which is caused by the vibrations and/or the expansions and retractions due to temperature changes, is reduced, which reduces abrasion. In addition, because the first and second spring sections 124*a*, 124*b* are substantially perpendicular to the first and second contact section 122*a*, 122*b*, the total length of the connector 1 in the mating direction is reduced.

We claim:

1. A connector, comprising:

a housing including a recess for receiving a mating connector, the housing being provided with first contact section receiving openings and first press-fit section receiving openings separated from the first contact receiving openings by the housing; and first contacts including first press-fit sections press-fitted into the first press-fit section receiving openings, the first contacts having first contact sections extending substantially parallel to the first press-fit sections that extend through the first contact section receiving openings into the recess, first spring sections connect the first press-fit sections to the first contact sections, the first spring sections elastically deform to cause the first contact sections to move with respect to a direction of insertion of the mating connector into the recess, the first contact sections being male contact sections.

2. The connector of claim 1, wherein the first contacts are formed from a stamped metal plate.

3. The connector of claim 1, wherein the first spring section is substantially U-shaped.

4. The connector of claim 1, wherein the first contacts include a first connection section that extends outside of the housing.

5. The connector of claim 1, wherein the housing includes a standoff.

6. The connector of claim 1, further comprising first projections arranged adjacent to the first spring sections such that the first spring sections abut the first projections during elastic deformation.

7. The connector of claim 6, wherein the first projections are formed on the first contacts.

8. A connector, comprising:

a housing including a recess for receiving a mating connector, the housing having a first housing section provided with first contact section receiving openings and first press-fit section receiving openings separated from the first contact receiving openings by the housing and a second housing section provided with second contact section receiving openings and second press-fit section receiving openings separated from the second contact receiving openings by the housing;

first contacts having first press-fit sections press-fined into the first press-fit section receiving openings, the first contacts having first contact sections extending substantially parallel to the first press-fit sections that extend through the first contact section receiving openings into the recess, first spring sections connect the first press-fit sections to the first contact sections, the first spring sections elastically deform to cause the first contact sections to move with respect to a direction of insertion of the mating connector into the recess, the first contact sections being male contact sections; and second contacts having second press-fit sections press-fitted into the second press-fit section receiving openings, the second contacts having second contact sections extending substantially parallel to the second press-fit sections that extend through the second contact section receiving openings into the recess, second spring sections connect the second press-fit sections to the second contact sections, the second spring sections elastically deform to cause the second contact sections to move with respect to a direction of insertion of the mating connector into the recess, the second contact sections being male contact sections.

9. The connector of claim 8, wherein the first and second contacts are formed from a stamped metal plate.

10. The connector of claim 8, wherein the first and second spring sections are substantially U-shaped.

11. The connector of claim 8, wherein the first contacts are shaped differently from the second contacts.

12. The connector of claim 8, wherein the first and second contacts include first and second connection sections, respectively, that extend outside of the housing.

13. The connector of claim 8, wherein the housing includes a standoff.

14. The connector of claim 1, wherein the first contact section receiving openings have inner walls that abut the first contact sections to prevent the first contact sections from moving in a direction perpendicular to the direction of insertion of the mating connector in the recess.

15. The connector of claim 8, wherein the first and second contact section receiving openings have inner walls that respectively abut the first and second contact sections to prevent the first and second contact sections from moving in a direction perpendicular to the direction of insertion of the mating connector in the recess.

16. The connector of claim 8, further comprising first projections arranged adjacent to the first spring sections such that the first spring sections abut the first projections during elastic deformation and second projections arranged adjacent to the second spring sections such that the second spring sections abut the second projections during elastic deformation.

17. The connector of claim 16, wherein the first and second projections are formed on the first and second contacts, respectively.

* * * * *